US005989802A

United States Patent [19]

Vandenabeele

[11] Patent Number: 5,989,802

[45] **Date of Patent: *Nov. 23, 1999**

[54] RECORDING MATERIALS AND METHOD FOR MANUFACTURING SAID MATERIALS COATED FROM HYDROPHILIC LAYERS HAVING NO GELATIN OR LOW AMOUNTS OF GELATIN

[75] Inventor: Hubert Vandenabeele, Mortsel, Belgium

[73] Assignee: Agfa-Gevaert, N.V., Mortsel, Belgium

[ * ] Notice: This patent issued on a continued prosecution application filed under 37 CFR 1.53(d), and is subject to the twenty year patent term provisions of 35 U.S.C. 154(a)(2).

[21] Appl. No.: 08/867,509

[22] Filed: Jun. 2, 1997

[30] Foreign Application Priority Data

Jun. 13, 1996 [EP] European Pat. Off. ..... 96201653

[51] Int. Cl.[6] ..... G03C 1/053; G03C 1/04; G03C 1/047; G03C 1/38

[52] U.S. Cl. ..... 430/627; 430/231; 430/232; 430/230; 430/523; 430/531; 430/536; 430/539; 430/628; 430/629; 430/631; 430/634; 430/642

[58] Field of Search ..... 430/631, 642, 430/539, 629, 232, 231, 217, 935, 628, 230, 523, 531, 536, 634

[56] References Cited

U.S. PATENT DOCUMENTS

| | | | |
|---|---|---|---|
| 3,168,403 | 2/1965 | Himmelmann et al. | 430/629 |
| 3,632,374 | 1/1972 | Greiller | 430/935 |
| 3,767,410 | 10/1973 | Brust et al. | 430/637 |
| 4,113,903 | 9/1978 | Choinski | 430/935 |
| 4,842,900 | 6/1989 | Miyamoto | 430/935 |
| 5,310,637 | 5/1994 | Kurz | 430/935 |
| 5,478,709 | 12/1995 | Vandenabeele | 430/523 |
| 5,618,650 | 4/1997 | De Keyzer et al. | 430/232 |
| 5,707,775 | 1/1998 | Deprez et al. | 430/232 |

*Primary Examiner*—Richard L. Schilling
*Attorney, Agent, or Firm*—Breiner & Breiner

[57] ABSTRACT

Recording materials and a method of manufacturing said materials by coating hydrophilic colloidal layer compositions on a support by slide-hopper or curtain-coating techniques, followed by drying, said materials comprising a support and one or more light-sensitive and/or heat-sensitive layer(s) having a hydrophilic colloidal coating composition comprising no gelatin(in the case of (photo)thermographic materials) or gelatin in low amounts in order to provide a ratio by weight of gelatin to silver halide expressed as an equivalent amount of silver nitrate in the range from 0.05 to 0.4 (in the case of a light-sensitive silver halide photographic material) and thickening agents composed of synthetic clay and anionic macromolecular polyelectrolytes and wherein said synthetic clay is present in an amount of at least 85% by weight versus a total amount of thickening agents.

4 Claims, No Drawings

RECORDING MATERIALS AND METHOD FOR MANUFACTURING SAID MATERIALS COATED FROM HYDROPHILIC LAYERS HAVING NO GELATIN OR LOW AMOUNTS OF GELATIN

1. FIELD OF THE INVENTION

The present invention relates to recording materials coated from layers having no gelatin or low amounts of gelatin.

2. BACKGROUND OF THE INVENTION

In photographic silver halide emulsion layers gelatin remains the principal binder. The demand for rapid processing, dimensional stability, and image sharpness has led to a steady decrease in the ratio of gelatin to silver halide. This ratio expressed by weight is further called "gesi". For the calculation of such ratio values the amount of silver halide is expressed therein as its equivalent amount of silver nitrate.

Thin emulsion layers resulting from lower amounts of gelatin as e.g. for multilayer color reversal films with a thickness of about 10 $\mu$m and for rapid access medical X-ray films with a thickness of at most 5 $\mu$m have been described in SPSE Handbook of Photographic Science and Engineering—Woodlief Thomas, Jr. Editor, SPSE—A Wiley Inter-science Publication—John Wiley & Sons, New York (1973), p. 514).

From "Photographic Chemistry" edited by Pierre Glafkidès, Vol. I, (1958), p. 314–315, it is known that a silver halide emulsion containing low amounts of gelatin with respect to silver halide will develop more rapidly, and that the gamma infinity will be reached more quickly.

Experimentally it has been found that in that way a higher sensitivity, also called "speed", can be attained for quite a lot of materials as well as an increase in covering power, defined as density measured per gram of developed silver in the region of maximum density.

However a decrease in the amount of gelatin and a reduction of the coating thickness brings about a series of problems of which coating unevenness and coating streaks are the most important. In terms of sensitometry the appearance of an enhanced fog and pressure sensitization or desensitization phenomena are the most well-known.

Coating a layer containing gelatin requires a viscosity of the coating liquid which is of particular importance and which is decisive for the choice of the coating technique. Modern coating apparatus used for high speed coating of aqueous coating liquids containing gelatin on web type film or paper supports are the slide-hopper coater and the curtain coater, described e.g. in U.S. Pat. Nos. 3,632,374 and 3,867,901 and in U.S. Pat. Nos. 2,761,791 and 4,113,903 and in EP-A 0 382 058 respectively.

When applying a method operating at high coating speed it is of utmost importance that after coating the layer containing gelatin on cooling solidifies as rapidly as possible and quickly reaches a degree allowing the drying to remove water from the coated layer, with a vigorous dry air current without distorting or destructing the already solidified layer containing gelatin in gel form. Only by combining rapid coating speed with short solidifying and drying stages the production speed of recording materials based on coatings from layers containing gelatin can be increased substantially.

It is known that silver halide emulsion coating solutions with low viscosities are more prone to instability in the coating bead before contact with the web, which causes coating defects, and undesired interlayer mixing in multilayer coating. Various thickening agents have been proposed to facilitate the coating of dilute photographic emulsions as has been described e.g. in U.S. Pat. No. 3,767,410. Many of these agents are not entirely compatible and exhibit problems such as the production of haze, brittleness, etc. Moreover use of anionic macromolecular polyelectrolytes is restricted to coatings in a particular pH region because of undesired coagulation of the gelatin, to a certain extent, in their presence.

As a practical matter e.g. in order to manufacture gelatinous photographic silver halide emulsion layers coated from low amounts of gelatin, it is therefore preferred to dispense with thickening agents and still to obtain a desired viscosity in the coating liquids containing gelatin correlated with a proper shear rate for fault-free coating. Nowadays coating velocities are increased by application of slide-hopper and curtain coating techniques, allowing also more rapid drying after coating as use is made of more concentrated coating compositions. Said more concentrated compositions require a higher viscosity, in particular when low amounts of gelatin are present in the said coating composition.

Coating of silver halide emulsion layers having a low gelatin content is particularly important when materials are envisaged that after image-wise exposure are subjected to rapid processing within a time of less than 90 seconds and even more if ultra rapid processing is applied as e.g. processing within a total time cycle from 20 to 60 seconds during which development, fixing, rinsing and drying of the photographic material is completed.

In this case even making use of gelatin having an increased viscosity is insufficient as has e.g. been described in EP-A 0 532 094. The preparation of gelatin suitable for producing aqueous solutions having high viscosity and rapid solidification is described e.g. in EP-A 0 025 494. Another method to provide a gelatin having a viscosity which is high enough in order to be useful in coating compositions of hydrophilic layers is a so-called "chain extended gelatin" as has been disclosed in WO 92/09008, wherein the viscosity is increased without gel formation or formation of insolubles. However if lower concentrations of gelatin are present in coating compositions it is not always possible to enhance the viscosity to the desired level as has already been suggested hereinbefore. Moreover the use of thickening agents, more in particular of anionic macromolecular polyelectrolytes, in order to obtain gelatinous solutions having strong shear rate dependency, is in many cases disadvantageous for rapid solidification of the layer or layers coated therefrom as sticking may form an additional problem.

Moreover, application of ultra-rapid processing normally proceeds at an elevated temperature e.g. in the temperature range of 30° C. to 45° C. in an automatic roller transport apparatus. Under such conditions silver halide emulsion layers having a low gelatin content have too low an abrasion resistance, may show roller marks and give rise to sludge formation.

Besides light-sensitive silver halide photographic materials also (photo)thermographic recording materials, wherein layers whether or not comprising silver salt in the absence of gelatin are present, demand for rapid coating and drying capability.

3. OBJECTS AND SUMMARY OF THE INVENTION

It is an object of the present invention to manufacture recording materials by coating said materials from aqueous coating compositions containing no gelatin or only low amounts of gelatin at high coating speed followed by rapid solidification on cooling.

More particularly it is an object of the present invention of coating, by means of a slide-hopper or curtain coater operating at high coating speed, materials comprising gelatinous photographic light-sensitive compositions having a gesi value of not more than 0.4, more preferably of not more than 0.3 and still more preferably of from 0.05 up to at most 0.2, said coating being followed by rapid solidification on cooling whereby drying of thus obtained photosensitive materials starts immediately after coating.

Further on it is more particularly an object of the present invention of coating by means of a slide-hopper or curtain coater operating at high coating speed materials comprising non-gelatinous (photo)thermographic compositions.

Other objects and advantages of the present invention will appear from the further description and from the examples.

According to the present invention a recording material and a method of manufacturing said material is provided, wherein said recording material comprises a support and a recording layer wherein said recording layer has a hydrophilic colloidal coating composition comprising a binder and thickening agents, said thickening agents being composed of synthetic clay and anionic macromolecular polyelectrolytes and wherein said synthetic clay is present in an amount of at least 85% by weight versus a total amount of thickening agent(s).

Further a method has been provided for manufacturing said recording material by coating hydrophilic colloidal layer compositions on a support by slide-hopper or curtain-coating techniques, followed by drying said materials comprising on at least one side of a support one or more light-sensitive and/or heat-sensitive layer(s) having a hydrophilic colloidal coating composition comprising no gelatin (in the case of (photo)thermographic materials) or gelatin in low amounts in order to provide a ratio by weight of gelatin to silver halide expressed as an equivalent amount of silver nitrate in the range from 0.05 to 0.4, more preferably of not more than 0.3 and still more preferably of from 0.05 up to at most 0.2 (in the case of a light-sensitive silver halide photographic material) and thickening agents as set forth hereinbefore.

4. DETAILED DESCRIPTION OF THE INVENTION

Natural clays are essentially hydrous aluminum silicates, wherein alkali metals or alkaline-earth metals are present as principal constituents. Also in some clay minerals magnesium or iron or both replace the aluminum wholly or in part. The ultimate chemical constituents of the clay mineral vary nt only in amounts, but also in the way in which they are combined or are present in various clay minerals. It is also possible to prepare synthetic clays in the laboratory, so that more degrees of freedom can lead to reproducible tailor made clay products for use in different applications.

So from the natural clays smectite clays, including laponites, hectorites and bentonites are well-known. For the said smectite clays some substitutions in both octahedral and tetrahedral layers of the crystal lattice occur, resulting in a small number of interlayer cations. Smectite clays form a group of "swelling" clays which take up water and organic liquids between the composite layers and which have marked cation exchange capacities.

From these smectite clays, synthetic chemically pure clays have been produced. So e.g. preferred synthetic smectite clay additives for the purposes of this invention are LAPONITE RD and LAPONITE JS, trade mark products of LAPORTE INDUSTRIES Limited, London. Organophilic clay and a process for the production thereof have been described in EP-A 0 161 411.

LAPONITE JS is described as a synthetic layered hydrous sodium lithium magnesium fluoro-silicate incorporating an inorganic polyphoshate peptiser. The said fluoro-silicate appears as free flowing white powder and hydrates well in water to give virtually clear and colorless colloidal dispersions of low viscosity, also called "sols". On addition of small quantities of electrolyte highly thixotropic gels are formed rapidly. The said thixotropic gels can impart structure to aqueous systems without significantly changing viscosity. An improvement of gel strength, emulsion stability and suspending power can be observed by making use of it in the said aqueous systems. Further advantages are the large solid surface area of about 350 $m^2/g$ which gives excellent adsorption characteristics, its stability over a wide range of temperatures, its unique capability to delay gel formation until desired and its synergistic behaviour in the presence of thickening agents. Further, its purity and small particle size ensures an excellent clarity. In aqueous solutions of many polar organic solvents it works as a very effective additive.

Laponite clay as a synthetic inorganic gelling agent for aqueous solutions of polar organic compounds has been presented at the Symposium on "Gums and Thickeners", organised by the Society of Cosmetic Chemists of Great Britain, held at Oxford, on Oct. 14, 1969. In Laporte Inorganics Laponite Technical Bulletin L104/90/A a complete review about structure, chemistry and relationship to natural clays is presented. Further in Laporte Inorganics Laponite Technical Bulletin L106/90/c properties, preparation of dispersions. applications and the product range are disclosed. A more detailed description of "Laponite synthetic swelling clay, its chemistry, properties and application" is given by B. J. R. Mayes from Laporte Industries Limited.

Although it was already known that synthetic clays are useful in layers of hydrophilic colloidal photographic materials in order to preserve antistatic properties as described in EP-A 0 644 454 and in order to reduce roller marks in automatic processing machines as described in EP-A 0 644 455, it has now unexpectedly been found that in the presence of the said clays in the particularly thin hydrophilic layers of recording materials of the present invention, the viscosity of coating compositions containing synthetic clays as described hereinbefore is enhanced and after coating of e.g. a light-sensitive material having synthetic clay said material can be rapidly run in an automatic processor without showing unevenness streaks. Even if the amount of hydrophilic binder has been reduced to a minimum level in order to obtain extremely thin coated, rapidly processable layers, the presence of the said synthetic swelling clays is working very efficiently against pressure marks that are induced by the conveying rollers in the processing of light-sensitive silver halide photographic materials.

Gelatin used as a hydrophilic binder in the present light-sensitive recording materials as e.g. photographic silver halide materials can be prepared advantageously starting from a so-called lime-treated collagen-containing pig skin, bone or cattle hide material. It is further known e.g. from the book "Photographic Emulsion Chemistry" by G. F. Duffin, The Focal Press London, (1966), p. 40, that the viscosity of a gelatin solution is highly dependent on pH and is at minimum at the iso-electric point. A gelatin preferably used according to the manufacturing method of the present invention has an isoelectric point below 6.

An aqueous composition used in the light-sensitive recording material of the present invention composed of layer(s) coated therefrom may contain the gelatin defined in EP-A 0 532 094, and the said gelatin may even be mixed together with other types of gelatin and/or synthetic, semi-synthetic, or natural polymers that are in dissolved or dispersed form. Hydrophilic binders present as synthetic substitutes for gelatin are e.g. polyvinyl alcohol, poly-N-vinyl pyrrolidone, polyvinyl imidazole, polyvinyl pyrazole, polyacrylamide, polyacrylic acid, and derivatives thereof, in particular copolymers thereof. Natural substitutes for gelatin are e.g. other proteins such as zein, albumin and casein, cellulose, saccharides, dextranes, starch, and alginates. In general, the semi-synthetic substitutes for gelatin are modified natural products e.g. gelatin derivatives obtained by conversion of gelatin with alkylating or acylating agents or by grafting of polymerisable monomers on gelatin such as the "chain extended gelatin" of the reference cited hereinbefore and cellulose derivatives such as hydroxyalkyl cellulose, carboxymethyl cellulose, phthaloyl cellulose, and cellulose sulphates.

Examples of latex polymers that are used in conjunction with binders, especially with gelatin, in coating compositions of recording layers coated according to the method of this invention are described in e.g. EP-A 0 383 283. Well-known examples are acrylate latex polymers as e.g. methyl or ethyl (meth)acrylate. A copolymer consisting of 95% by weight of ethylacrylate and 5% by weight of methacrylic acid is e.g. very useful, as well as a terpolymer of butadiene, methylmethacrylate and itaconic acid.

Optionally the additional binder should dispose of functional groups which allow reaction with an appropriate hardening agent in order to provide a sufficiently mechanically resistant layer. Such functional groups are especially amino groups, but also carboxylic groups, hydroxy groups, and active methylene groups.

In light-sensitive aqueous coating compositions used in the recording materials of the present invention a hardening agent for gelatin is present or is added after coating in an amount sufficient to make the gelatin insoluble in aqueous photographic processing liquids once settled and dehydrated. In the production of photographic gelatinous light-sensitive silver halide emulsion materials containing layers on the basis of (mainly) gelatin the hardening agent(s) make that a coated and dried layer produced from said composition obtains sufficient mechanical strength to withstand treatment conditions applied in the processing of photographic gelatin-silver halide emulsion materials, especially when low amounts of gelatin are present and when low "gesi"-values are attained in said materials.

Hardeners for use in coating methods wherein coating compositions mainly contain gelatin (e.g. in an amount of up to 70% by weight versus the total amount of hydrophilic colloid binder as for light-sensitive recording materials in the present invention) are subject to no restriction with respect to the type of hardener. Examples of suitable gelatin hardeners have been described in the book "The Theory of the Photographic Process", 4th ed. by of T. H. James, Macmillan Publishing Co., Inc. New York (1977) p. 78–84. Aldehyde hardeners such as formaldehyde, glyoxal and glutaraldehyde are particularly useful. Other very suitable hardening agents are s-triazines, e.g. 2,4-dichloro-6-hydroxy-s-triazine in the form of a water soluble sodium salt and active olefins as e.g. bis(vinylsulphonyl) compounds, more particularly 1,3-vinylsulphonyl-2propanol, bis-vinylsulphonyl methyl or bis-vinyl sulphonyl ethyl ether and better water-soluble hydroxy substituted vinyl sulphonyl hardeners.

The hardening agents may be used in the presence of hardening accelerators e.g. 1,3-dihydroxybenzenes also described in the book of T. H. James, p. 84, mentioned above. Other types of hardening agents known as quick acting hardeners for gelatin are e.g. carbamoylpyridinium salts described in U.S. Pat. No. 4,987,063 and hardening agents containing phosphor described in published EP-A 0 408 143, chromium salts as e.g. chromium acetate and chromium alum, aldehydes as e.g. formaldehyde, glyoxal, and glutaraldehyde, N-methylol compounds as e.g. dimethylolurea and methyloldimethylhydantoin, dioxan derivatives as e.g. 2,3-dihydroxy-dioxan, active vinyl compounds as e.g. 1,3,5-triacryloyl-hexahydro-s-triazine, active halogen compounds as e.g. 2,4-dichloro-6-hydroxy-s-triazine, and mucohalogenic acids as e.g. mucochloric acid and mucophenoxychloric acid. These hardeners can be used alone or in combination. The binder can also be hardened with fast-reacting hardeners such as carbamoylpyridinium salts as disclosed in U.S. Pat. No. 4,063,952 and with the onium compounds as disclosed in EP-A 0 408 143.

Coating compositions having low concentrations of gelatin or even having no gelatin present in hydrophilic layers of recording materials as in this invention are advantageously used in the production of all kinds of recording materials, photo-sensitive and heat-sensitive, but are particularly useful in the production of photographic gelatin type silver halide emulsion layer materials and photothermographic materials coated from layers comprising at least one silver salt. The said photothermographic materials preferably have no gelatin as a binder in the hydrophilic recording layer(s).

In the said photographic material said hydrophilic colloid composition may be applied in one or more anti-halation layer(s), filter layer(s), subbing layer(s), interlayer(s), a backing layer, a protective covering layer called antistress layer, etc.

In at least one silver halide emulsion layer(s) however, according to this invention, said composition is applied wherein a ratio by weight of gelatin to silver halide expressed as an equivalent amount of silver nitrate is not more than 0.40, preferably from 0.05 to 0.25 and still more preferably from 0.05 to 0.15.

Coating of an aqueous gelatinous composition may proceed by any technique known in the art for the coating of aqueous coating compositions e.g. by air knife coating, meniscus coating, doctor blade coating, roll coating, wire bar coating, dip coating, but in the method of this invention slide hopper coating and curtain coating are preferred from the viewpoint of coating velocity.

According to the present invention preferred coating techniques in order to manufacture a recording material composed of layers having an aqueous hydrophilic composition are the slide hopper coating and the curtain coating technique wherein coating proceeds on a moving web and wherein several different aqueous coating compositions are coated simultaneously as a multiple layer assemblage.

In one embodiment wherein low amounts of gelatin are used in coating compositions containing gelatin as a dispersing agent and binder for silver halide grains the coverage of silver halide expressed as an equivalent amount of silver nitrate per $m^2$ may vary widely and is e.g. in the range of 2 to 10 $g/m^2$. In film type photographic materials as e.g. materials wherein the support is transparent the silver halide coverage expressed as an equivalent amount of silver nitrate per $m^2$ is in the range from 4 to 7 g per $m^2$, whereas for silver halide photographic materials having an opaque support as e.g. polyethylene coated paper support a silver halide coverage equivalent with a silver nitrate coverage of 1 to 4 g per $m^2$ is applied. According to this invention silver salt expressed as an equivalent amount of silver nitrate is coated in a total amount of up to 5 g/$m^2$ in one or more light-sensitive recording layers.

Further according to the present invention coated recording materials are composed of at least one protective antistress layer present as an outermost layer, wherein said protective antistress layer comprises gelatin in an amount of at most 1.2 g/$m^2$, and more preferably from 0.3 to at most 1.1 g/$m^2$. In a preferred embodiment said protective antistress layer is present on top of a layer containing at least one silver salt and still more preferably on top of a layer containing one or more silver halide emulsions.

So in particular (photo)thermographic recording materials are provided with a protective layer in order to avoid local deformation of the (photo)-addressable thermally developable element, to improve its resistance against abrasion and to prevent its direct contact with components of the apparatus used for thermal development. The protective layer comprising a binder, which may be water soluble (hydrophilic) or water dispersible, preferably contains the preferred gelatin, but polyvinylalcohol, cellulose derivatives or other polysaccharides, hydroxyethylcellulose, hydroxypropylcellulose etc., can also be present. Further descriptions of suitable embodiments can be found in EP-Application No. 96200648, filed Mar. 9, 1996.

Gelatin having a higher viscosity can be used in the manufacturing method according to the present invention, but desired coatings can only be made if synthetic clay is used in those so-called "low gesi" materials or even "gelatin-free" coating materials. For coating layers containing silver salts with a gesi lower than 0.25 a curtain coater is preferably used and curtain coating methods are preferably applied.

Conventional lime-treated or acid treated gelatin can be used as an (additional) binder, especially in light-sensitive silver halide photographic materials. The preparation of such gelatin types has been described in e.g. "The Science and Technology of Gelatin", edited by A. G. Ward and A. Courts, Academic Press 1977. page 295 and next pages. The gelatin can also be an enzyme-treated gelatin as described in Bull. Soc. Sci. Phot. Japan, No 16, page 30 (1966). To minimise the amount of gelatin, said gelatin can be replaced in part or integrally by synthetic polymers as cited hereinbefore or by natural or semi-synthetic polymers. Natural substitutes for gelatin are e.g. other proteins such as zein, albumin and casein, cellulose, saccharides, starch, and alginates. Semi-synthetic substitutes for gelatin are modified natural products as e.g. gelatin derivatives obtained by conversion of gelatin with alkylating or acylating agents or by grafting of polymerizable monomers on gelatin, and cellulose derivatives such as hydroxyalkyl cellulose, carboxymethyl cellulose, phthaloyl cellulose, and cellulose sulphates.

For use in silver halide light-sensitive recording materials according to the present invention the halide composition of silver halide emulsion layers is not restricted and may be any composition selected from i.a. silver chloride, silver bromide, silver iodide, silver chlorobromide, silver chloroiodide, silver chlorobromoiodide, silver bromoiodide and silver bromochloroiodide. However for obtaining the highest gamma infinity results the content of silver chloride is preferably at least 80 mole %. Iodide is preferably present in an amount of less than 5 mole %, more preferably less than 3 mol % but amounts of iodide of not more than 2 mole % and even an iodide content of from 0.1 to 1 mole % is most preferred in said crystals. Photosensitive silver halide crystals can be prepared by mixing halide and silver solutions in partially or fully controlled conditions of temperature, concentrations, sequence of addition, and rates of addition. Silver halide can be precipitated according to the single-jet method, the double-jet method, or the conversion method in the presence of gelatin and/or gelatin derivatives. Care should be taken if colloidal silica is used as a protective colloid: electrical charges of colloidal silica, interacting with synthetic clay may be destructive for the colloidal stability and transparency of the coating compositions. Therefore colloidal silica should preferably be avoided or excluded as a protective colloid of silver halide crystals and/or as a binder material added to recording layers.

The silver halide particles of the photographic emulsions used in recording materials of the present invention may have a regular crystalline form such as a cubic or octahedral form or they may have a transition form. They may also have an irregular crystalline form such as a spherical form or a tabular {111} or {100} form, or may otherwise have a composite crystal form comprising a mixture of said regular and irregular crystalline forms. Regular as well as tabular crystals may thus be present, as well as mixtures thereof. Crystals having a different crystal habit may be coated in different layers as has e.g. been described in EP-A 0 770 909, in order to get the desired blackness of the developed silver.

Silver halide grains may also have a multilayered grain structure. According to another embodiment the grains may comprise a core and a shell, which may have different halide compositions and/or may have undergone different modifications such as the addition of dopes. Besides having a differently composed core and shell the silver halide grains may also comprise different phases inbetween.

Two or more types of silver halide emulsions that have been prepared differently can be mixed for forming a photographic emulsion for use in accordance with the present invention.

The size distribution of the silver halide particles of the photographic emulsions for use in recording materials according to the present invention can be homodisperse or heterodisperse. A homodisperse size distribution is obtained when 95% of the grains have a size that does not deviate more than 30% from the average grain size. The average grain size of the silver halide may vary according to the requirements for image resolution and speed and is e.g. less than 100 nm as e.g. micrate emulsions having an average particle size diameter of about 50 nm, but is normally in the range of 0.1 to 3 $\mu$m. More particularly silver halide crystals having a regular crystal habit preferably have an average grain size of at least 0.15 $\mu$m, up to at most 1.2 $\mu$m, more preferably up to 1.0 $\mu$m and still more preferably up to 0.8 $\mu$m. Silver halide crystals having tabular {111} or {100} major faces accounting for at least 50% of the total projected area preferably have an average diameter from 0.5 to 2.5 $\mu$m and an average thickness from 0.06 to at most 0.3 $\mu$m, and even more preferred up to at most 0.2 $\mu$m. Average aspect ratios of from 2 to 20 and more preferred from 5 to 15 are preferred.

Silver halide crystals can be doped with group VIII elements of the periodic Table, preferably with $Ru^{2+}$, $Rh^{3+}$ and/or $Ir^{4+}$, and likewise or in addition thereto with $Cd^{2+}$, $Zn^{2+}$, $Pb^{2+}$ or mixtures thereof.

The emulsion can be desalted in the usual ways e.g. by dialysis, by flocculation and redispersing, or by ultrafiltration.

The light-sensitive silver halide emulsion containing gelatin as defined for use in light- and/or heat-sensitive recording materials according to the present invention can be a so-called primitive emulsion, in other words an emulsion that has not been chemically sensitized. However, the light-sensitive silver halide emulsion can be chemically sensitised as described i.a. in the above-mentioned "Chimie et Physique Photographique" by P. Glafkides, in the above-mentioned "Photographic Emulsion Chemistry" by G. F. Duffin, in "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968).

Chemical sensitization can be carried out as described in said literature by effecting the ripening in the presence of small amounts of compounds containing sulphur e.g. thiosulphate, thiocyanate, thioureas, sulphites, mercapto compounds, and rhodamines. The emulsions can be sensitized also by means of gold, sulphur, selenium or tellurium ripeners, a combination thereof or by means of reductors e.g. tin compounds as described in GB-A 789,823, amines. hydrazine derivatives, formamidine-sulphinic acids, and silane compounds. Chemical sensitization can also be performed with small amounts of Ir, Rh, Ru, Pb, Cd, Hg, Tl, Pd, Pt, or Au. One of these chemical sensitisation methods or a combination thereof can be used.

The light-sensitive silver halide emulsions containing gelatin for use according to the present invention can be spectrally sensitized with methine dyes such as those described by F. M. Hamer in "The Cyanine Dyes and Related Compounds", 1964, John Wiley & Sons. Dyes that can be used for the purpose of spectral sensitization include cyanine dyes, merocyanine dyes, complex cyanine dyes, complex merocyanine dyes, homopolar cyanine dyes, hemicyanine dyes, styryl dyes and hemioxonol dyes. Particularly valuable dyes are those belonging to the cyanine dyes, merocyanine dyes, complex merocyanine dyes. Other dyes, which per se do not have any spectral sensitization activity, or certain other compounds, which do not substantially absorb visible radiation, can have a supersensitization effect when they are incorporated together with said spectral sensitizing agents into the emulsion. Suitable supersensitizers are i.a. heterocyclic mercapto compounds containing at least one electronegative substituent as described e.g. in U.S. Pat. No. 3,457,078, nitrogen-containing heterocyclic ring-substituted aminostilbene compounds as described e.g. in U.S. Pat. Nos. 2,933,390 and 3,635,721, aromatic organic acid/formaldehyde condensation products as described e.g. in U.S. Pat. No. 3,743,510, cadmium salts, and azaindene compounds.

By the presence of considerably low amounts of gelatin in "low gesi" silver halide emulsion layers much thinner layers can be coated having less tendency to swell and having shorter solidification and drying times. Thinner layers having a higher silver halide concentration provide a shorter way to processing solution ingredients for their interaction with the silver halide grains than is the case with silver halide emulsion layers rich in gelatin. Materials containing such layers are therefore particularly useful in ultra rapid access processing.

Commonly used developers for rapid access development of light-sensitive silver salt recording materials are usually on the basis of hydroquinone as a main developing agent and a pyrazolidinone derivative compound as e.g. 1-phenyl-3-pyrazolidine-1-one (optionally N-methyl-p-aminophenol in suitable applications) as an auxiliary developing agent in the presence of sulphite ions. Developing liquids containing an auxiliary developing agent as defined hereinbefore are more stable with respect to oxygen of the air than lith type developers containing hydroquinone as the sole developing agent and only a small amount of free sulphite. An alternative for lith-type developers on the basis of the presence of hydrazine type compounds in combination with hydroquinone type compounds and auxiliary developing agents has been described e.g. in U.S. Pat. No. 4,650,746.

Alternative and more ecologically justified developer solutions and/or methods of processing silver halide photographic materials have recently been described in EP-A 0 732 619; in EP-A 0 731 381 and the corresponding U.S. Pat. No. 5,593,817; in EP-A 0 731 382 and the corresponding U.S. Pat. No. 5,604,082; and in Research Disclosure 371052, published Mar. 1. 1995.

Production of silver halide emulsion layers with a relatively high silver halide packing density due to the presence of low amounts of binder than is commonly encountered is further in favour of the production of images having high "covering power". By "covering power" is understood the ratio of diffuse optical density (D) measured to the amount in grams of developed silver per $dm^2$. Silver halide emulsion layers offering a high covering power can be coated at smaller silver halide coverage which makes the production of silver halide photographic materials less expensive because therein silver content is a dominating economic feature.

Another important advantage of photographic silver halide emulsion recording materials wherein use is made of coated layers having low gesi values according to the present invention is the property to yield particularly contrasty images. Such is e.g. proved by a raise in maximum gradient by lowering "gesi" in combination with lith-development described by Mora C. under the title : "The Lith process" in J. Inf. Rec. Mater. 15 (1987) 1, p. 20–21. Lith-development yields silver images with high maximum gradient or gamma infinity (e.g. above 8) which is desirable in the reproduction of line work and halftone images.

Silver halide emulsion for use in recording materials according to the present invention may comprise compounds preventing the formation of fog or stabilizing the photographic characteristics during the production or storage of photographic elements or during the photographic treatment thereof. Many known compounds can be added as fog-inhibiting agent or stabilizer to the silver halide emulsion. Suitable examples are i.a. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methylbenzotriazole), nitrobenzotriazoles, mercaptotetrazoles, in particular 1-phenyl-5-mercapto-tetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB-A 1,203,757; GB-A 1,209,146; JP-A 75-39537 and GB-A 1,500,278; and 7-hydroxy-s-triazolo-[1,5-a]-pyrimidines as described in U.S. Pat. No. 4,727,017, and other compounds such as benzenethiosulphonic acid, benzenethiosulphinic acid, benzenethiosulphonic acid amide. Other compounds that can be used as fog-inhibiting compounds have been described e.g. in Research Disclosure No 17643 (1978), Chapter VI.

Fog-inhibiting agents or stabilizers can be added to the silver halide emulsion prior to, during, or after the ripening thereof and mixtures of two or more of these compounds can be used.

Recording materials of the present invention may further comprise various kinds of surface-active agents in the photographic emulsion layer or in at least one other hydrophilic colloid layer. Suitable surface-active agents include non-ionic agents such as saponins, alkylene oxides e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts, glycidol derivatives, fatty acid esters of polyhydric alcohols and alkyl esters of saccharides: anionic agents comprising an acid group such as a carboxy, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes e.g. as coating aids, as compounds preventing electric charges, as compounds improving slidability, as compounds facilitating dispersive emulsification, as compounds preventing or reducing adhesion, and as compounds improving the photographic characteristics e.g higher contrast, sensitization, and development acceleration.

Development acceleration can be accomplished with the aid of various compounds, preferably polyalkylene derivatives having a molecular weight of at least 400 such as those described in e.g. U.S. Pat. Nos. 3,038,805; 4,038,075 and 4,292,400.

Recording elements of the present invention may further comprise various other additives such as e.g. compounds improving the dimensional stability, UV-absorbers, spacing agents and plasticizers.

Suitable additives for improving the dimensional stability of the recording element are i.a. dispersions of a water-soluble or hardly soluble synthetic polymer e.g. polymers of alkyl (meth)acrylates, alkoxy(meth)acrylates, glycidyl (meth)acrylates,(meth)acrylamides, vinyl esters, acrylonitriles, olefins, and styrenes, or copolymers of the above with acrylic acids, methacrylic acids, α-β-unsaturated dicarboxylic acids, hydroxyalkyl (meth)acrylates, sulphoalkyl (meth)acrylates, and styrene sulphonic acids.

Suitable UV-absorbers are i.a. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 2784/71, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455.

Photographic silver halide emulsions layers containing gelatin in low amounts as in the present invention can be used in various types of photographic elements such as used in so-called amateur and professional photography. For example, in photographic elements for graphic art reproduction, for negative type and direct positive type photographic elements, diffusion transfer reversal (DTR) photographic elements, and non-photosensitive image-receiving materials, in low-speed e.g. room light insensitive photographic materials, high-speed photographic elements such as radiographic X-ray films which preferred materials according to the present invention, and which are used in combination with X-ray fluoresent intensifying screens and laser beam sensitive films sensitive e.g. to He—Ne gas laser beam or semi-conductor solid state laser beams of relatively low energy.

Another application of recording materials according to this invention is specifically situated in the field of heat-sensitive materials and more preferably in the field of photothermographic recording materials which are e.g. used for both the production of transparencies and reflection type prints.

Supports and subbing layers useful for the recording materials according to this invention, can be those as described in RD 36544 (published September 1994), chapter XV, polyethylene naphthalate inclusive. The support can be transparent or opaque, dependent on the specific application mentioned hereinbefore. For example, a paper base substrate can be present which may contain white reflecting pigments, optionally also applied in an interlayer between a recording material and said paper base substrate. A transparent base, if used, may be colourless or coloured e.g. with a blue coloured pigment.

In (photo)thermographic recording materials e.g. a white opaque base is used, whereas in the medical diagnostic field black-imaged transparencies are widely used in inspection techniques operating with a light box. An extensive overview of supports, antistatic layers, substantially light-insensitive organic silver salts, reducing agents, auxiliary reducing agents, spectral sensitisers, binder, weight ratio of binder to organic silver salt, thermal solvents, toning agents, anti-halation dyes and other additives as well as recording processes and applications is further given in the already cited EP-Application No. 96200648, filed March 9, 1996, which is incorporated herein by reference.

Further information on photographic light-sensitive silver halide emulsions, preparations, addenda, processing and systems can be found in Research Disclosure dated December 1989, item 308119 and in Research Disclosure dated September 1994, item 36544, mentioned above.

The present invention is illustrated by the following examples without however limiting it thereto.

5. EXAMPLES

Example 1

A photographic silver iodobromide emulsion containing 2.0 mole % of silver iodide was prepared by a conventional single jet method in a vessel containing 40 g of phthaloyl gelatin. The ammoniacal silver nitrate solution was held at 42° C. as well as the emulsion vessel, containing the halide salts. At a constant rate of 300 ml per minute the precipitation time was ended after 10 minutes and followed by a physical ripening time of 40 minutes. After that time an additional amount of 20 g of gelatin was added.

The obtained emulsion was of an average grain diameter of 0.62 μm and contained approximately 90 g of silver nitrate per kg of the dispersion after addition of 3 moles of silver nitrate.

After addition of sulphuric acid to a pH value of 3.5 stirring was stopped and after sedimentation the supernatant liquid was removed. The washing procedure was started after a scrape-rudder was installed and after addition of polystyrene sulphonic acid in the first turn to get a quantitative flocculate without silver losses.

During the redispersion of the emulsion 150 g of gelatin were added so that the weight ratio of gelatin to silver nitrate was 0.42, the emulsion containing an amount of silver bromoiodide equivalent with 190 g of silver nitrate pro kg.

The emulsion crystals were chemically ripened with sulphur and gold at 47° C. for 4 hours to get an optimised relation between fog and sensitivity.

Emulsion Coatings A–C.

The emulsion was stabilized with 4-hydroxy-6-methyl-1,3,3a,7-tetra-azaindene and after addition of the normal coating additives the solutions were coated simultaneously together with a protective layer containing 1.1 g gelatine per $m^2$ per side on both sides of a polyethylene terephthalate film support having a thickness of 175 $\mu$m by means of the slide-hopper coating technique.

The resulting photographic materials A. B and C contained (per side) an amount of silver halide corresponding to 3.5 grams of $AgNO_3$ per $m^2$.

Differences between those three materials were the following:

Material A: gesi of the emulsion layer: 0.4.

Material B: gesi of the emulsion layer: 0.3.

Material C: same gesi of 0.3 as in Material B. except for the addition of 300 ml of LAPONITE RDS (5 wt %) per kg of silver bromoiodide emulsion.

LAPONITE RDS used herein is a trademarked product from Laporte Industries, Ltd., UK.

Further differences are summarized in Table 1, wherein additional amounts in the silver halide emulsion layer of polystyrene sulphonic acid (PSSA) (in ml from a 5 wt % solution added per kg of silver bromoiodide emulsion) are given, the viscosity (VISCO)(in mPas.) measured for the silver halide emulsion coating solution and a qualitative evaluation of the emulsion stability of said coating solution (STABILITY).

TABLE 1

| Material | GESI | PSSA | PSSA/GEL | VISCO | STABILITY |
|---|---|---|---|---|---|
| A | 0.4 | 65 | 0.042 | 28 | good |
| B | 0.3 | 71 | 0.064 | 23 | bad |
| C | 0.3 | 10 | 0.009 | 30 | good |

From Table 1 it is clear that with very low amounts of polystyrene sulphonic acid present as an anionic macromolecular polyelectrolyte used in order to enhance the viscosity of the emulsion, a colloidally stable light-sensitive emulsion composition is obtained provided that a synthetic clay like LAPONITE RDS is present in an amount such that even when a ratio by weight of PSSA versus gelatin is less than 0.01 a viscosity can be obtained which is high enough in order to provide a high colloidal stability and coating ability. Even if no PSSA is present higher amounts of LAPONITE RDS will be able to provide sufficient stability and thus coating ability.

Example 2

The same Material as Material C from Example 1 was reproduced, except for the addition to the silver bromoiodide emulsion layer of 200 ml of a LAPONITE RDS (5 wt %) instead of 300 ml. An optimisation was made with respect to amounts of polystyrene sulphonic acid (PSSA) required to get colloidally stable coating compositions for emulsion coating solutions prepared in order to apply two different coating techniques: the slide-hopper and the curtain-coater coating technique respectively.

In Table 2, amounts of PSSA are given, as well as values of the viscosities of the coating solutions and the wet layer thickness (thickness after coating before drying (in $\mu$m)) of the coated emulsion layer of the Materials D (coated by the slide-hopper coating technique) and E (curtain coating technique) respectively.

TABLE 2

| Material | PSSA | VISCO | THICKNESS |
|---|---|---|---|
| D | 20 | 25 | 43 |
| E | 8 | 40 | 30 |

From Table 2 it is clear that results are obtained which are especially in favour of the curtain coating technique which requires even higher viscosities of the coating solutions than the slide-hopper technique and which offers the opportunity to obtain thinner coated layers.

The optimum value of the viscosity required for curtain coating is higher than for slide-hopper coating and is partially realised by concentrating the emulsion, which results in a lower wet layer thickness.

In the absence of LAPONITE RDS, a still higher amount of PSSA is required to get about the same viscosity values (and layer thickness) as given in Table 2 hereinafter.

In combination with LAPONITE RDS amounts of PSSA (per kg of the emulsion) are strongly reduced as has further been illustrated in Table 3.

Moreover the presence of LAPONITE RDS offers the opportunity to get a better emulsion stability.

TABLE 3

| Material | PSSA (without LAPONITE) | PSSA (+10 g of LAPONITE) |
|---|---|---|
| D | 70 | 20 |
| E | 50 | 8 |

Lower values of the GESI of the emulsion layers (e.g. 0.3 instead of 0.4) require a ratio of PSSA to gelatin enhance with about 50%.

As is well-known PSSA is a flocculating agent for gelatinous emulsions when the pH is decreased to a value of about 3.0. At relatively high ratios of PSSA to gelatin however flocculation already starts at coating pH values between 6.0 and 7.0, which leads to stability problems. It is clear that in combination with LAPONITE low amounts of PSSA are sufficient to reach the optimum viscosity without stability problems of the coating solution.

Example 3

A composition was prepared as follows in order to coat a heat-sensitive recording material. Therefore a silver behenate/silver halide-emulsion was prepared in situ as follows.

Silver behenate was prepared by dissolving 34 g (0.1 moles) of behenic acid in 340 mL of 2-propanol at 65° C. converting the behenic acid to sodium behenate by adding 400 mL of 0.25 M aqueous sodium hydroxide to the stirred behenic acid solution and finally adding 250 mL of 0.4 M aqueous silver nitrate the silver behenate precipitating out.

This was filtered off and then washed with a mixture of 10% by volume of 2-propanol and 90% by volume of deionised water to remove residual sodium nitrate.

After drying at 45° C. for 12 h, the silver behenate was dispersed in deionized water with the anionic dispersion agents Ultravon™ W and Mersolat™ H80 paste an aqueous solution producing after rapid mixing to produce a predispersion and homogenisation with a micro-fluidizer a finely divided and stable dispersion containing 20% by weight of silver behenate, 2.1% by weight of Utravon™ W and 0.203% by weight of Mersolat™ H80. The pH of the resulting dispersion was adjusted to about 6.5.

The following ingredients were then added with stirring to 1.5 g of the silver behenate dispersion: 1 g of a 30% by weight concentration of a latex-copolymer (obtained by copolymerizing methyl methacrylate, butadiene and itaconic acid in a weight ratio of 45:45:10), 0.013 g of succinimide, 0.1 g of a 11% by weight solution of saponin in a mixture of deionised water and methanol and 2.4g of a 1.28% by weight aqueous solution of 3-(triphenyl-phosphonium) propionic acid bromide perbromide, corresponding to a concentration of 8 mol % with respect to silver behenate, in order to accomplish in situ conversion of part of the silver behenate to silver bromide.

The emulsion layer coating composition was comprising a 2.44% by weight aqueous solution of 3-(3,4-dihydroxyphenyl)propionic acid. Coating compositions F to L were prepared, differing in additional amounts of LAPONITE RDS (in ml 5 wt %) and, as a result thereof, in viscosity (expressed in mPa.s) as has been illustrated in Table 4.

TABLE 4

| Coating Composition | LAPONITE RDS (5%) | Viscosity (mPa · s) |
|---|---|---|
| F | — | too low |
| G | 750 | too low |
| H | 1000 | 8.23 |
| I | 1250 | 32.4 |
| J | 1500 | 60.0 |
| K | 1750 | too viscous |
| L | 2000 | too viscous |

Table 4 illustrates that the viscosity of coating compositions can perfectly be adapted to the required value and no more gelatin or no more polyelectrolytes is(are) desired in order to enhance the viscosity and in order to provide colloidal stability and coating ability of the said compositions.

I claim:

1. Method for coating by slide-hopper or curtain-coating, followed by drying, a recording material comprising on at least one side of a support a recording layer coated by said method, said recording layer having a hydrophilic colloidal coating composition comprising an aqueous coating composition containing no gelatin and thickening agents composed of synthetic clay and anionic macromolecular polyelectrolytes and wherein said synthetic clay is present in an amount of at least 85% by weight versus the total amount of thickening agents.

2. Method according to claim 1, wherein said synthetic clay is a synthetic smectite clay.

3. Recording material manufactured according to the method of claim 1, wherein said material is a light-sensitive material or a heat-sensitive material comprising a silver salt.

4. Recording material prepared according to the method of claim 3, wherein said silver salt is coated in an amount of up to 5 g/m$^2$, said amount being expressed as an equivalent amount of silver nitrate.

* * * * *